US005692346A

United States Patent [19]

Irvine et al.

[11] Patent Number: 5,692,346

[45] Date of Patent: Dec. 2, 1997

[54] APPARATUS AND METHOD FOR CONNECTING A PANEL WITH A SUPPORT FRAME

[75] Inventors: George A. Irvine, Kildeer; Arvid L. Johnson, Schaumburg, both of Ill.

[73] Assignee: Airtite Contractors Inc., Chicago, Ill.

[21] Appl. No.: 613,230

[22] Filed: Mar. 8, 1996

[51] Int. Cl.[6] ..... E04B 9/26

[52] U.S. Cl. ..... 52/506.09; 52/506.08; 52/511; 52/712; 52/747.1; 248/320

[58] Field of Search ..... 52/506.07, 506.08, 52/506.09, 511, 712, 745.06, 747.1, 747.11, 762, 773, 777, 778, 780; 248/317, 320, 343

[56] References Cited

U.S. PATENT DOCUMENTS

| | | | |
|---|---|---|---|
| 1,997,580 | 4/1935 | Gibson et al. . | |
| 1,997,581 | 4/1935 | Heeren et al. . | |
| 1,997,582 | 4/1935 | Heeren et al. | 52/506.09 X |
| 1,997,595 | 4/1935 | Nold et al. | 52/506.09 |
| 1,997,605 | 4/1935 | Strom et al. . | |
| 1,997,606 | 4/1935 | Strom . | |
| 1,997,607 | 4/1935 | Strom . | |
| 1,998,423 | 4/1935 | Stubbs . | |
| 2,009,512 | 7/1935 | Offutt et al. . | |
| 3,875,717 | 4/1975 | Moeller | 52/506.08 |
| 4,463,537 | 8/1984 | Rodriquez et al. | 52/506.07 |
| 4,951,443 | 8/1990 | Caferro | 52/506.07 X |
| 5,024,034 | 6/1991 | Gailey | 52/506.07 |

FOREIGN PATENT DOCUMENTS

| | | | |
|---|---|---|---|
| 355920 | 9/1961 | Switzerland | 52/506.09 |

*Primary Examiner*—Carl D. Friedman
*Assistant Examiner*—Kevin D. Wilkens
*Attorney, Agent, or Firm*—Tarolli, Sundheim, Covell, Tummino & Szabo

[57] ABSTRACT

An improved retainer element has a mounting section which is connected with a rim portion of a panel. A longitudinally extending main spring section of the retainer element extends from the mounting section. A retainer section of the retainer element is connected with an end of the main spring section opposite from the mounting section. The retainer section includes a retainer flange and a pair of retainer arms which engage opposite sides of the rim portion of the panel. When the panel is moved into position relative to the support frame, a cam surface on the retainer flange engages the support frame and transmits force to deflect the main spring section of the retainer element. The retainer flange then snaps into engagement with the support frame. The retainer arms slide along opposite side surfaces of the rim portion of the panel to guide movement of the main spring section relative to the panel. A positioning spring section of the retainer element presses against the support frame to position the panel relative to the support frame.

31 Claims, 5 Drawing Sheets

APPARATUS AND METHOD FOR CONNECTING A PANEL WITH A SUPPORT FRAME

BACKGROUND OF THE INVENION

The present invention relates to a new and improved apparatus and method for connecting a panel with a support frame and more specifically to a retainer element which connects a sheet metal panel with a support frame. The support frame may be a grid in a suspended ceiling.

Sheet metal panels have previously been connected with support frames. In one specific instance, a rim portion of a sheet metal panel was provided with longitudinally extending ridges to engage a support frame. However, difficulty was encountered in moving the ridges on the rim portion of the sheet metal panel into a desired position relative to the support frame. This resulted in the use of hammers and boards to pound the sheet metal panel into the desired position relative to the support frame. Of course, once a sheet metal panel has been installed in this difficult and time consuming manner, it is difficult to remove the sheet metal panel.

SUMMARY OF THE INVENTION

The present invention relates to a method and apparatus for use in connecting a panel with a support frame. The apparatus includes an improved retainer element having a mounting section which is connectable with a rim portion of the panel. The retainer element has a main spring section which extends outward from the mounting section. A retainer section is disposed at an end of the main spring section opposite from the mounting section. The retainer section engages both the rim portion of the panel and the support frame to interconnect the panel and the support frame. A positioning spring section is advantageously provided to apply force against the support frame to urge the panel to a desired position relative to the support frame.

The retainer section of the retainer element includes retainer arms which engage opposite side surfaces on the rim portion of the panel. A retainer flange has a cam surface which is engageable with the support frame to deflect the main spring section as the panel is positioned relative to the support frame. The retainer arms cooperate with the rim portion of the panel to guide movement of the main spring section relative to the rim portion of the panel.

When a panel is to be disconnected from the support frame, a flexible removal tool is inserted between the panels and pressed against the main spring section of the retainer element. Force transmitted from the removal tool to the main spring section of the retainer element deflects the main spring section. As the main spring section is deflected, the retainer flange is moved out of engagement with the support frame.

BRIEF DESCRIPTION OF THE DRAWINGS

The foregoing and other features of the invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
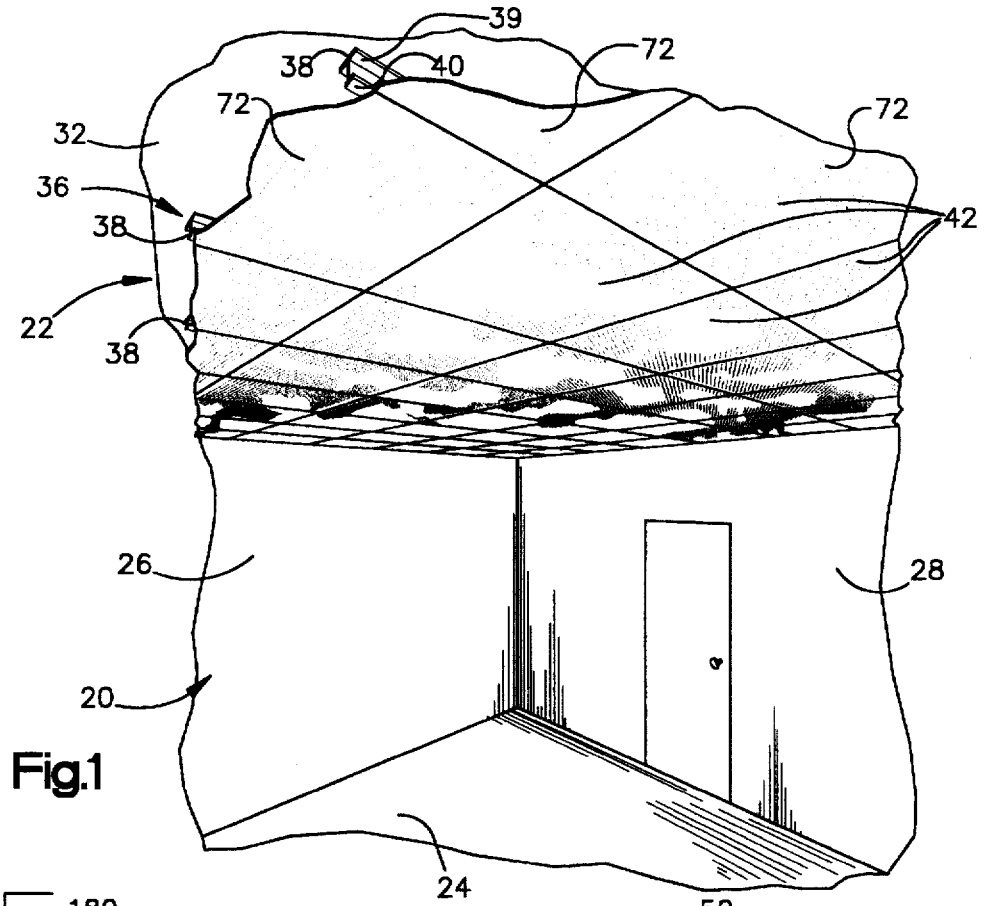
FIG. 1 is a fragmentary pictorial illustration of a building room having a ceiling system.

A room 20 (FIG. 1) in a building has a metal ceiling system 22. The room 20 has a floor 24 and walls 26 and 28. A ceiling 32 of the building extends parallel to the floor 24 and perpendicular to the walls 26 and 28. The metal ceiling system 22 is connected with the building ceiling 32.

The ceiling system 22 includes a support frame 36 which is connected with the building ceiling 32. The support frame 36 includes parallel linear support members or beams 38 which are connected with the building structure 32. The support members 38 have a generally I-shaped cross sectional configuration. The support members 38 may have a different configuration if desired. For example, the support members 38 could have a T-shaped configuration.

An upper flange 39 of the support member 38 is connected with the building ceiling 32. A lower flange 40 of the support member 38 is disposed below the building ceiling 32 and extends parallel to the building ceiling. In the illustrated embodiment of the metal ceiling system 22, the support members 38 are mounted directly on the building ceiling 32, in a manner generally similar to that disclosed in U.S. Pat. Nos. 1,997,582 and 1,998,423. However, it is contemplated that it may be preferred to have the support members 38 suspended below the building structure in a manner similar to that disclosed in U.S. Pat. Nos. 1,997,606 and 1,997,607. The support members 38 could form a grid and be suspended from a building structure in many different known ways.

In addition to the support frame 36 (FIG. 1), the metal ceiling system 22 includes an array of rectangular metal panels 42 which are connected with the support frame. Sound absorbent material (not shown) may be disposed directly on the metal panels 42 or may be mounted above the metal panels in a known manner. It should be understood that the support frame 36 may be the grid of a suspended ceiling if desired.

Although the support frame 36 and panels 42 have been illustrated in FIG. 1 as being part of a ceiling system 22, it is contemplated that the support frame and panels could be part of a metal wall system if desired. It should also be understood that although the ceiling system 22 has been shown in FIG. 1 as being disposed within a building, the ceiling system could be disposed in a structure where it is exposed to the environment around the building, such as, on a canopy. Although it is preferred to use metal panels 42 in the ceiling system 22, panels formed of other materials could be utilized if desired.

Each of the panels 42 is connected with the support frame 36 by a plurality of identical retainer elements 48 (FIG. 2) which are constructed and installed in accordance with one of the features of the present invention. The improved retainer elements 48 are connected with a rectangular rim portion 52 of the panel 42. The rim portion 52 of the metal panel 42 extends upward when the panel is installed in a ceiling system 22 (FIG. 1). The rim portion 52 (FIG. 2) of the panel 42 extends around the periphery of a flat rectangular main section 54 of the panel.

In the illustrated embodiment of the invention, the retainer elements 48 are located along opposite parallel edge portions 56 and 58 (FIG. 2) of the rectangular rim portion 52 of the panel 42. The retainer elements 48 are disposed adjacent to corner portions 62, 64, 66, and 68 of the rectangular flat sheet metal main section 54 of the panel 42. Since the retainer elements 48 all have the same construction, the retainer elements along the edge portion 56 of the metal panel 42 have an orientation which is opposite from the orientation of the retainer elements 48 along the edge portion 58 of the metal panel. The retainer elements 48 along the edge portion 56 of the metal panel 42 engage a first one of the support members 38 (FIG. 1) in the support frame 36 while the retainer elements along the opposite edge portion 58 of the metal panel engage a next adjacent parallel support member in the support frame.

The main section 54 (FIG. 2) of each of the metal panels 42 is spaced the same distance from the building ceiling 32 (FIG. 1) by cooperation between the retainer elements 48 and the support frame 36. Thus, a flat lower major side surface 72 (FIG. 1) on each of the metal panels 42 is disposed the same distance from the building floor 24 and extends parallel to the building floor. In the illustrated embodiment of the invention, the main section 54 (FIG. 2) of the sheet metal panel 42 is perforated by small circular openings. However, the perforations could be eliminated or could have a different configuration if desired.

Each retainer element 48 (FIGS. 3 and 4) cooperates with the panel 42 and support frame 36 to position the panel relative to the support frame. The retainer element 48 includes a mounting section 76 which connects the retainer element 48 with a rim portion 52 of the panel 42. A longitudinally extending main spring section 78 extends from the mounting section 76. A retainer section 80 is disposed at an end of the main spring section 78 opposite from the mounting section 76.

The retainer section 80 includes a panel engaging section 82 and a support frame engaging section 84. The panel engaging section 82 engages the rim portion 52 of the panel 42. The support frame engaging section 84 engages a support member 38 (FIGS. 1 and 5) in the support frame 36. A positioning spring section 86 (FIGS. 3 and 4) engages the rim portion 52 of the metal panel and a support member 38 in the support frame 36 (FIG. 5) to position the metal panel 42 relative to the support frame.

Panel

The rectangular panel 42 (FIG. 2) is integrally formed as one piece of sheet metal. The panel 42 includes a flat perforated main section 54 having a rectangular configuration. The rectangular rim portion 52 extends around the periphery of the main section 54.

Figure 2:
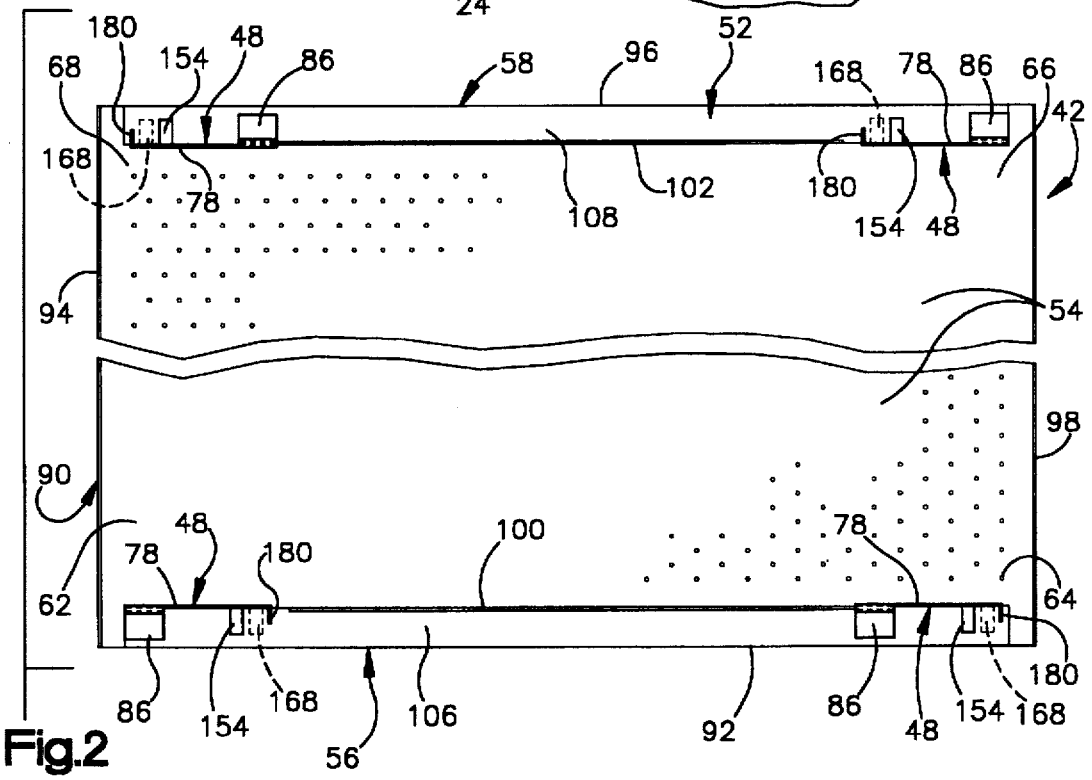
FIG. 2 is an enlarged fragmentary plan view of a sheet metal panel and retainer elements used in the ceiling system of FIG. 1.

The rim portion 52 of the panel includes an outer side wall 90. The outer side wall 90 is formed in four linear sections 92, 94, 96 and 98 (FIG. 2). The outer side wall sections 92 and 96 extend parallel to each other and perpendicular to the main section 54. The outer side wall sections 94 and 98 extend parallel to each other and perpendicular to the side wall sections 92 and 96 and to the main section 54.

The two opposite edge portions 56 and 58 (FIG. 2) of the rim portion 52 extend parallel to each other and include the outer side wall sections 92 and 96. The two edge portions 56 and 58 include linear inner side walls 100 and 102. The inner side walls 100 and 102 extend parallel to each other and to the outer side wall sections 92 and 96. The inner side walls 100 and 102 extend perpendicular to the main section 54 of the metal panel 42 and to the outer side wall sections 94 and 98.

The rim portion 52 has connector walls 106 and 108 extend parallel to the main section 54 of the metal panel 42 and extend perpendicular to the outer side wall sections 92 and 96 and inner side walls 100 and 102. In the illustrated embodiment of the metal panel 42, the outer side wall sections 94 and 98 of the rim portion 52 stand alone and are not provided with connector walls and inner side walls. Of course, the sections 94 and 98 of the outer side wall 90 could have inner side walls and connector walls if desired.

The retainer element 48 is mounted on the inner side wall 100 (FIG. 3) of the rim portion 52. Thus, the inner side wall 100 of the rim portion 52 includes a mounting segment 114 (FIG. 3) which extends parallel to the outer side wall 90 and perpendicular to the connector wall 106. The mounting section 76 of the retainer element 48 engages the mounting segment 114 of the inner side wall 100 (FIG. 4).

Figure 3:
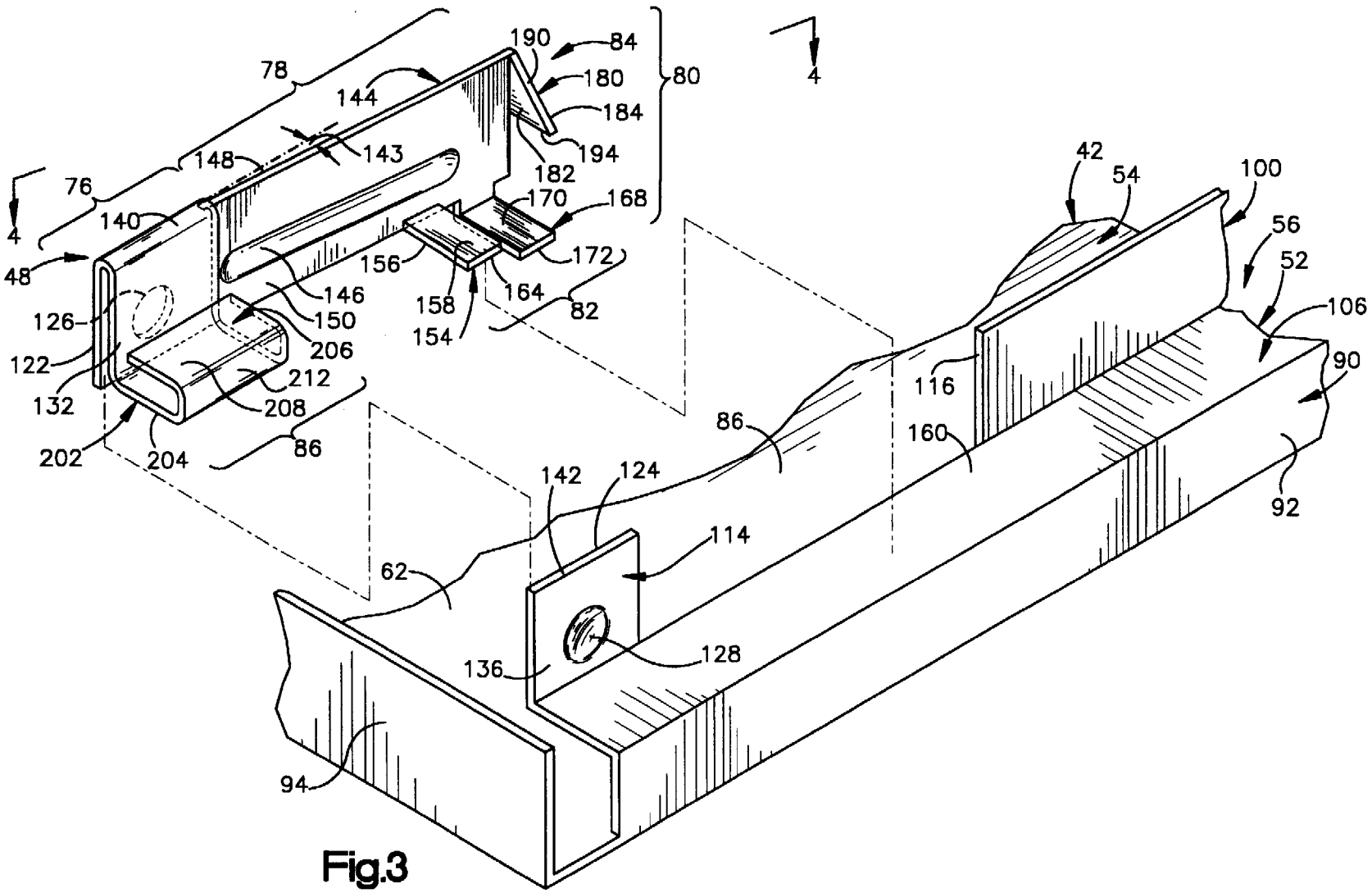
FIG. 3 is an enlarged fragmentary pictorial illustration of a rim portion of the sheet metal panel of FIG. 2 and a retainer element, the retainer element being disconnected from the panel.
Figure 4:
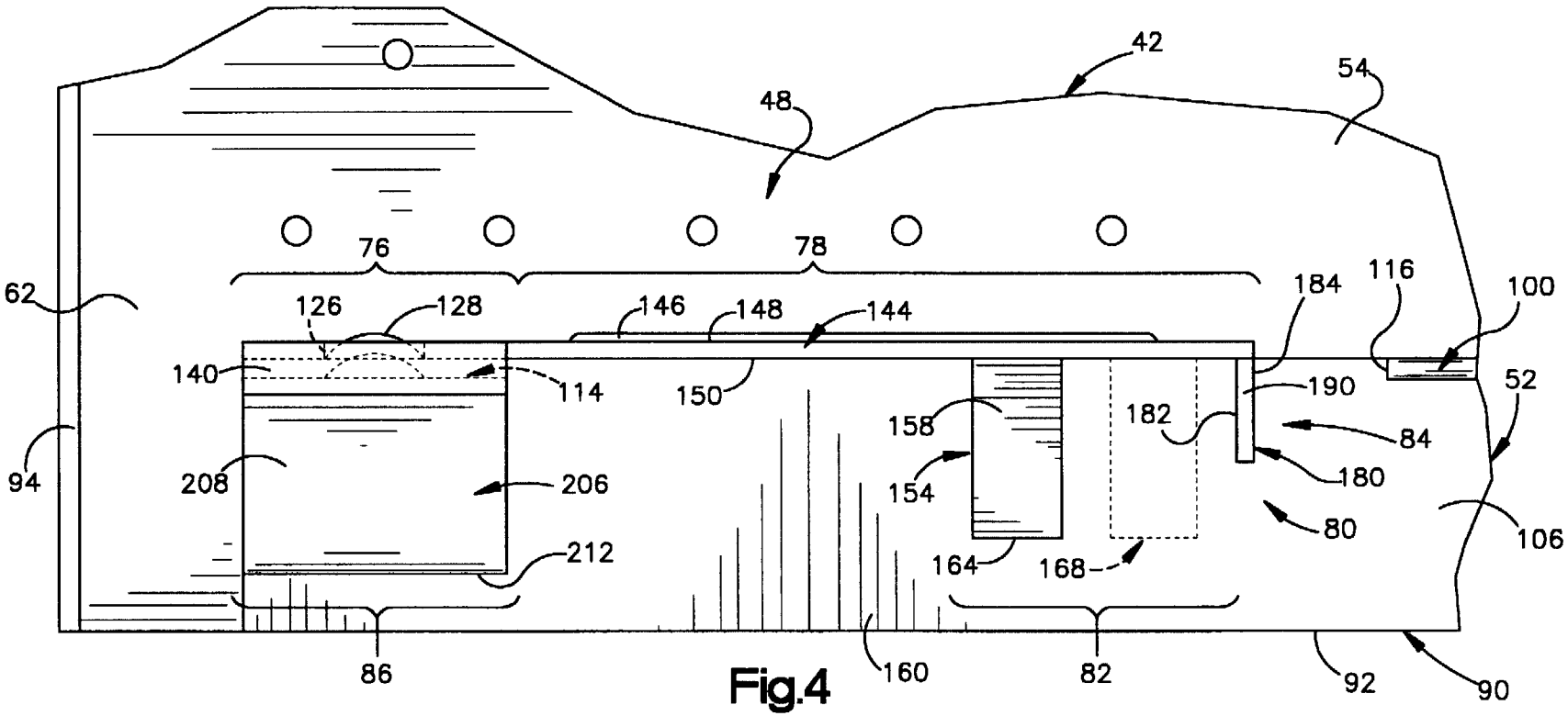
FIG. 4 is a plan view, taken generally along the line 4—4 of FIG. 3, illustrating the relationship between the rim portion of the panel and the retainer element when the retainer element is connected with the rim portion of the panel.
Figure 5:
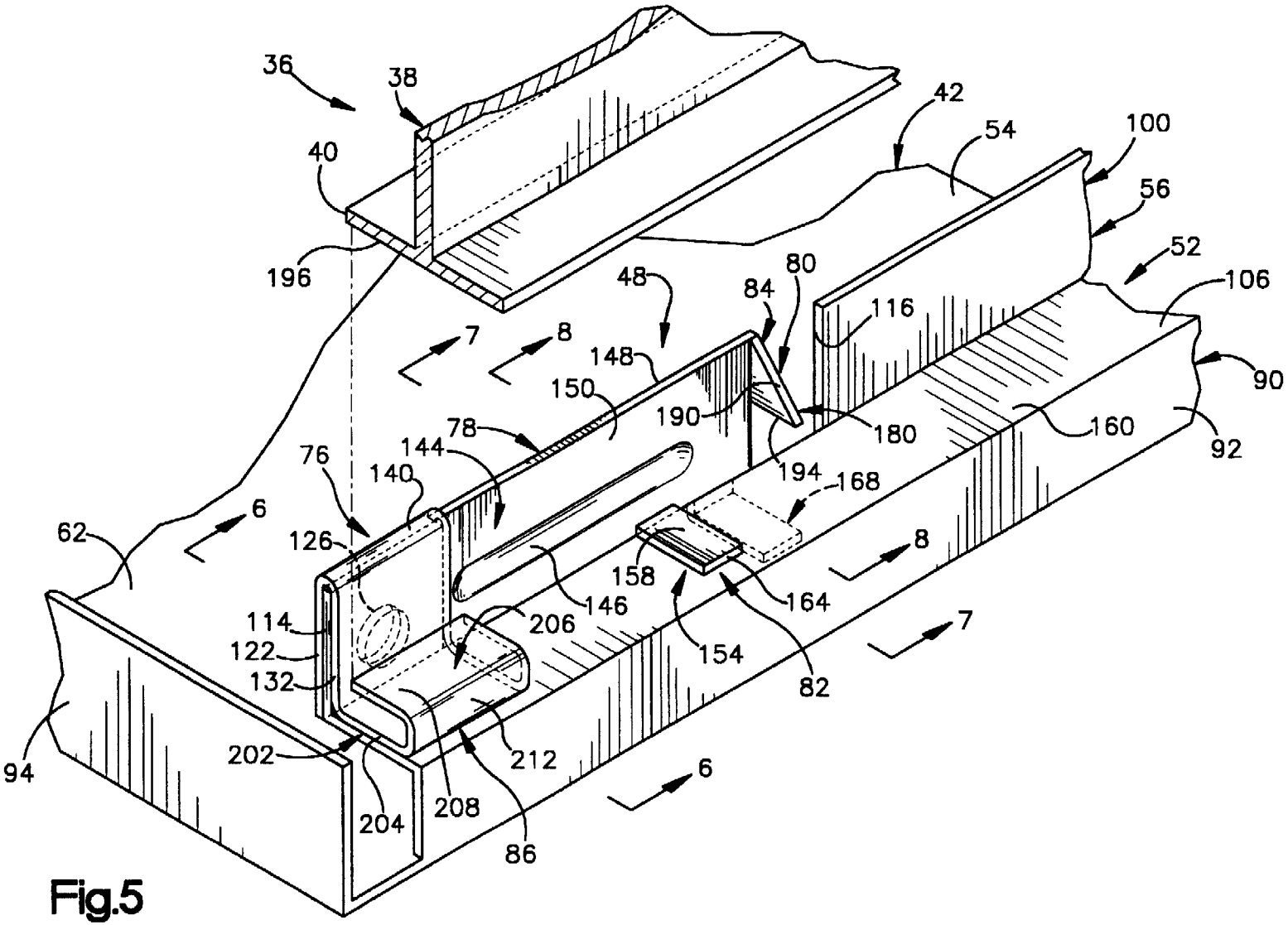
FIG. 5 is an enlarged pictorial illustration of the retainer element mounted on the rim portion of the panel and depicting the relationship of the retainer element to a support frame member in the ceiling system of FIG. 1 prior to installation of the panel.

The inner side wall 100 has a rectangular opening 116 (FIG. 3) through which the retainer section 80 of the retainer element 48 extends (FIGS. 4 and 5). In the illustrated embodiment of the invention, the opening 116 has a rectangular configuration and has a longitudinal extent which is greater than the longitudinal extent of the main spring section 78 of the retainer element 48 (FIGS. 3, 4 and 5). However, if desired, the opening 116 could be formed as a plurality of slots. The panel engaging section 82 could extend through one of the slots and the support frame engaging section 84 could extend through the other slot. Of course, there may be many other possible configurations for the opening 116.

Retainer Element

Figure 6:
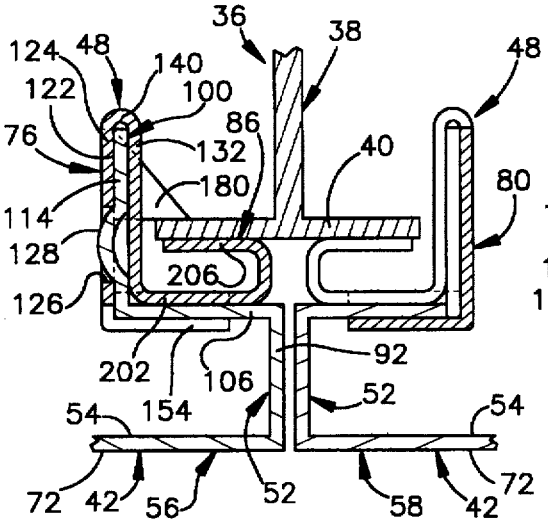
FIG. 6 is a fragmentary sectional view, taken generally along the line 6—6 of FIG. 5, illustrating the relationship of a pair of sheet metal panels and retainer elements to a support frame member in the ceiling system of FIG. 1 when the panels are installed in the ceiling system.

The mounting section 76 (FIGS. 3 and 6) of the retainer element 48 connects the retainer element with the mounting segment 114 of the inner side wall 100 on the rim portion 52 of the metal panel 42. The mounting section 76 of the retainer element 48 includes a rectangular base section 122 which engages an inner side surface 124 on the mounting segment 114. The base section 122 of the mounting section 76 has a circular locating opening 126 which engages a circular locating dimple or projection 128 formed in the mounting segment 114 (FIGS. 3, 4 and 6).

The locating dimple or projection 128 on the mounting segment 114 cooperates with the locating opening 126 in the base section 122 of the mounting section 76 of the retainer element 48 to position the retainer element longitudinally along the length of the inner side wall 100. In addition, engagement of the locating dimple 128 on the inner side wall 100 with the locating opening 126 in the mounting section 76 holds the mounting section of the retainer element 48 against movement relative to the inner side wall 100 during connection and/or disconnection of the metal panel 42 with the support frame 36 (FIG. 1).

In addition, the mounting section 76 (FIG. 3) includes a rectangular outer or second section 132. The outer or second section 132 of the mounting section 76 extends parallel to the base section 122 and is coextensive with the base section 122. The outer section 132 of the mounting section 76 engages an outer side surface 136 on the mounting segment 114.

A connector section 140 of the mounting section 76 (FIGS. 3 and 6) interconnects the base section 122 and outer or second section 132. When the retainer element 48 is mounted on the mounting segment of the inner side wall 100, the connector section 140 extends across an upper edge portion 142 (FIG. 3) of the mounting segment. The base section 122, outer section 132 and connector section 140 of the mounting section 76 are integrally formed from a single piece of sheet metal.

The resiliently deflectable main spring section 78 (FIGS. 3 and 7) extends from and is integrally formed as one piece with the mounting section 76. The main spring section 78 (FIG. 3) is connected with the base section 122 of the mounting section 76. As originally formed, the main spring section 78 is bent at an angle of approximately 10° to the mounting section 76. This angle has been indicated at 143 in FIG. 3. When the retainer element 48 is positioned on the rim portion 52, the main spring section 78 is resiliently deflected, in a counterclockwise direction as viewed in FIG. 4, by engagement with an edge of the connector wall 106.

When the retainer element 48 is installed on the rim portion 52 of the panel 42, the main spring section 78 has a longitudinal central axis which extends parallel to the longitudinal central axis of the inner side wall 100 of the rim portion 52 and to the main section 54 of the panel 42. The main spring section 78 extends at least part way across the opening 116 in the inner side wall 100 (FIGS. 4 and 5). The natural resilience of the main spring section 78 presses the main spring section against an edge of the connector wall 106.

The main spring section 78 of the retainer element 48 includes a rectangular body section 144 (FIG. 3). A longitudinally extending recess 146 (FIGS. 3 and 7) is formed in the body section 144. The recess 146 has a longitudinal central axis which extends parallel to the longitudinal central axis of the body section 144. The recess 146 projects rearward (FIGS. 4 and 7) from an inner side surface 148 of the body section 144 and opens to an outer side surface 150 of the body section. The rectangular inner and outer side surfaces 148 and 150 of the body section 144 extend parallel to the inner side wall 100 and perpendicular to the connector wall 106 of the rim portion 52. The recess 146 reinforces the main spring section 78 and provides it with the desired stiffness to resist unwanted deflection from the initial position shown in FIG. 5.

The retainer section 80 (FIGS. 3, 5 and 8) is integrally formed as one piece with the main spring section 78. The retainer section 80 is disposed at an end of the main spring section 78 (FIG. 3) opposite from the mounting section 76. As was previously mentioned, the retainer section 80 includes a panel engaging section 82 and a support frame engaging section 84. Both the support frame engaging section 84 and panel engaging section 82 extend through the opening 116 in the inner side wall 100 when the retainer element 48 is mounted on the rim portion 52 of the panel 42 (FIGS. 4 and 5).

Figure 7:
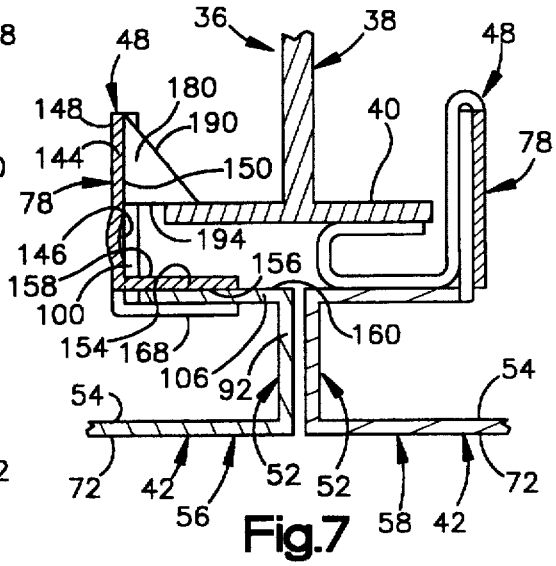
FIG. 7 is a fragmentary sectional view, taken generally along the line 7—7 of FIG. 5, further illustrating the relationship of the retainer elements and sheet metal panels to the frame member in the ceiling system.

The panel engaging section 82 (FIG. 3) of the retainer element 48 includes an upper retainer arm 154 (FIGS. 3, 4 and 7). The upper retainer arm 154 has a rectangular lower side surface 156 and a rectangular upper side surface 158. The rectangular lower side surface 156 of the upper retainer arm 154 slides on an upper side surface 160 on the connector wall 106 of the rim portion 52 when the retainer element 48 is mounted on the rim portion.

The upper retainer arm 154 extends perpendicular to the outer side surface 150 of the main spring section 78. The upper retainer arm 154 extends through the opening 116 in the inner side wall 100 (FIGS. 4 and 5). The upper retainer arm 154 has a length, as measured perpendicular to the outer side surface 150 of the main spring section 78, which is less than the width of the connector wall 106 (FIGS. 4, 5 and 7). Therefore, when the retainer element 48 is installed on the rim portion 52 of the metal panel 42, an outer edge 164 (FIGS. 3, 4 and 5) of the upper retainer arm 154 is spaced inward from the outer side wall 90 of the rim portion 52.

Figure 8:
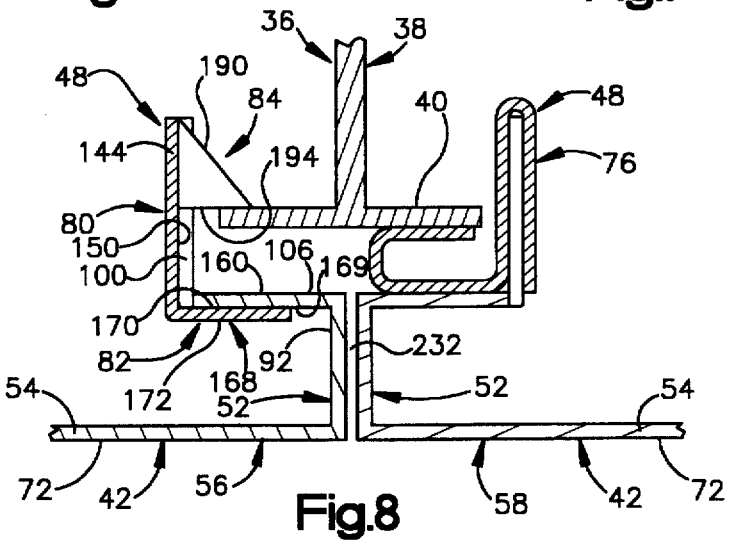
FIG. 8 is a fragmentary sectional view, taken generally along the line 8—8 of FIG. 5, further illustrating the relationship of the retainer elements and sheet metal panels to the frame member in the ceiling system.

The panel engaging section 82 also includes a lower retainer arm 168 (FIGS. 3 and 8). The lower retainer arm 168 engages a lower side surface 169 (FIG. 8) of the connector wall 106. Thus, the lower retainer arm 168 has a flat rectangular upper side surface 170 which engages an inner or lower side surface 169 of the connector wall 106. The upper side surface 170 of the lower retainer arm 168 extends parallel to the lower side surface 156 (FIG. 7) on the upper retainer arm 154. The lower retainer arm 168 has a lower side surface 172 which extends parallel to the upper side surface 170 and perpendicular to the outer side surface 150 of the main spring section 78.

The upper and lower retainer arms 154 and 168 are offset from each other by a distance which corresponds to the thickness of the connector wall 106 of the rim portion 52. However, the spacing between the upper side surface 170 of the lower retainer arm 168 and lower side surface 156 of the upper retainer arm 154 is sufficient to enable the retainer arms to freely slide along the connector wall 106 upon deflection of the main spring section 78 of the retainer element 48.

The lower retainer arm 168 has the same length as the upper retainer arm 154 (FIGS. 4 and 7). The length of the upper and lower retainer arms 154 and 168 is sufficient to enable the retainer arms to remain in engagement with the connector wall 106 upon deflection of the main spring section 78 of the retainer element 48. This enables the upper and lower retainer arms 154 and 168 to slide on the connector wall 106 and guide movement of the main spring section 78 relative to the connector wall 106 during installation and/or removal of the panel 42 from the ceiling suspension system 22.

The support frame engaging section 84 (FIG. 3) projects outward from the end of the main spring section 78 and is integrally formed as one piece with the main spring section. The support frame engaging section 84 transmits force between a support member 38 (FIGS. 1 and 8) in the support frame 36 and the main spring section 78 (FIG. 5) of the retainer element 48 during installation of the panel 42. The force transmitted by the support frame engaging section 84 deflects the main spring section 78 during installation of the panel 42 and supports the panel once it has been installed.

The support frame engaging section 84 includes a retainer flange 180 (FIG. 3) which projects outward from the end of the main spring section 78 opposite from the mounting section 76. The retainer flange 180 is integrally formed as one piece with the main spring section 78. The retainer flange 180 extends through the opening 116 in the inner side wall 100 of the rim portion 52 (FIGS. 4 and 5). The retainer flange 180 has a generally triangular configuration. The retainer flange 180 has opposite major side surfaces 182 and 184 (FIGS. 3 and 4) which extend perpendicular to the outer side surface 150 of the main spring section 78 and to the upper side surface 160 of the connector wall 106.

The retainer flange 180 has a linear cam surface 190 (FIGS. 3, 5 and 8) which slopes downward and outward from the body section 144 of the main spring section 78. In the illustrated embodiment of the invention, the cam surface 190 slopes at an angle of approximately 45°. Of course, the cam surface 190 could slope at a different angle if desired.

A linear retainer surface 194 is disposed on the retainer flange 180. The retainer surface 194 extends outward from the main spring section 78. The linear retainer surface 194 extends perpendicular to the side surface 150 of the main spring section 78 and parallel to the upper side surface 160 of the connector wall 106 of the rim portion 52. The retainer surface 194 also extends parallel to the lower side surface 156 of the upper retainer arm 154 and to the upper side surface 170 of the lower retainer arm 168.

During installation of the metal panel 42 with the retainer element 48 secured to the inner side wall 100 of the rim portion 52 (FIG. 5), the cam surface 190 engages the flange 40 on a support member 38 in the support frame 36 to resiliently deflect the main spring section 78. Prior to resilient deflection of the main spring section 78 by engagement of the cam surfaces 190 with the flange 40 on the support member 38, the main spring section is pressed against the connector wall 106 by deflection of the main spring section from the unrestrained condition of FIG. 3 to the installed condition of FIG. 4. Upon engagement of the cam surface with the flange 40 on the support member 38, the main spring section 78 is further deflected.

Once the retainer flange 180 has cleared the flange 40 on the support member 38, the resilient main spring section 78 returns to the position shown in FIGS. 4 and 8 with a snap action. As this occurs, the retainer surface 194 on the retainer flange 180 moves into engagement with the flange 40 on the support member 38. Simultaneously therewith, the main spring section 78 impacts against the connector wall 106. This results in an audible click. The click or noise resulting from impacting of the main spring section 78 against the panel 42 can be heard by an installer and functions as a signal to indicate that the retainer element 48 has moved into engagement with the support member 38.

The positioning spring section 86 (FIG. 3) engages a lower side 196 (FIGS. 5 and 6) of the lower flange 40 on the support member 38 to position the downwardly facing lower side surface 72 (FIGS. 1 and 6) of the panel 42 a predetermined distance below the support member 38. The positioning spring section 86 is integrally formed as one piece with and extends outward from the outer or second section 132 of the mounting section 76 (FIG. 3). The positioning spring section 86 includes a rectangular base section 202 which extends perpendicular to the side surface 150 of the main spring section 78. The base section 202 of the positioning spring section 86 has a flat lower side surface 204 which is engageable with the upper side surface 160 of the connector wall 106 in the rim portion 52 of the panel 42.

In addition, the positioning spring section 86 includes a rectangular force applicator section 206 which extends parallel to the base section 202. The rectangular force applicator section 206 has an upper side surface 208. The flat upper side surface 208 is engageable with a lower side surface 196 (FIG. 5) on the lower flange 40 of a support member 38 when the panel 42 is installed in a metal ceiling system 22. A connector section 212 is integrally formed as one piece with the force applicator section 206 and the base section 202 and interconnects the force applicator and base sections of the positioning spring section 86.

In one specific preferred embodiment of the retainer element 48, the retainer element had an overall length of approximately 2.50 inches. In this specific embodiment of the retainer element 48, the retainer element was integrally formed of one piece of sheet metal having a thickness of approximately 0.015 inches. In this specific embodiment of the invention, the main spring section 78 had a width of approximately 0.562 inches.

It is contemplated that the dimensions of the retainer element 48 may be varied depending upon the type of ceiling system with which the retainer element is to be used. In a reveal type ceiling system, it is contemplated that the retainer element 48 will have a smaller positioning spring section 86. It should be understood that the foregoing specific dimensions for the retainer element 48 have been set forth herein merely for purposes of clarity of description and it is not intended to limit the invention to any specific dimensions for the retainer element. In fact, it is contemplated that the retainer element 48 may be constructed with dimensions which are significantly different from the foregoing dimensions.

Installation

When the metal panel 42 (FIG. 2) is to be installed in the metal ceiling system 22, the retainer elements 48 are first connected with the corner portions 62, 64, 66 and 68 of the metal panel 42. To connect the retainer element 48 with the corner portion 62 of the metal panel 42, the retainer element is aligned with the inner side wall 100 on the rim portion 52 of the metal panel 42 (FIG. 3). At this time, the locating opening 126 in the base section 122 of the mounting section 76 will be directly above and aligned with the locating dimple or projection 128 on the mounting segment 114 of the inner side wall 100. The main spring section 78 of the retainer spring is bent or offset by the angle 143 relative to the mounting section 76.

The retainer element 48 is then moved downward (FIG. 3) and the mounting section 76 is pressed onto the mounting segment 114 of the inner side wall 100. As this occurs, the lower side surface 172 of the lower retainer arm 168 in the panel engaging section 82 moves into abutting engagement with the upper side surface 160 of the connector wall 106 in the rim portion 52. As the mounting section 76 is moved onto the mounting segment 114, the arcuate side surfaces of the dimple or projection 128 engage the locating opening 126 and center the mounting section 76 relative to the mounting segment 114 of the inner side wall 100. This results in the mounting section 76 being properly positioned relative to the rim portion 52 of the panel 42. However, at this time, both the upper retainer arm 154 and the lower retainer arm 168 are disposed above the upper side surface 160 of the connector wall 106.

To position the upper and lower retainer arms 154 and 168 relative to the connector wall 106, the resilient main spring section 78 of the retainer clip is pressed inward, that is away from the outer side wall 90 of the rim portion 52. As this occurs, the outer end of the lower retainer arm 168 moves clear of the connector wall 106. The main spring section 78 of the retainer element 48 is then pressed downward and released. This results in the lower side surface 156 on the upper retainer arm 154 engaging the connector wall 106. At this time, the lower retainer arm 168 will have moved below the connector wall 106 and the upper side surface 170 on the lower retainer arm will be disposed in engagement with the lower side surface of the connector wall 106. This results in the connector wall 106 being gripped between the upper and lower retainer arms 154 and 168.

When the retainer element 48 is mounted on the panel 42, the bend or offset indicated by the angle 143 in FIG. 3 is eliminated. The main spring section 78 is aligned with the mounting section 48 (FIG. 4) by engagement with the panel 42. Therefore, the main spring section 78 is resiliently deflected by approximately 10° and presses against an edge of the connector wall 106 with a resilient preload force.

After all four retainer elements 48 have been mounted on the rim portion 52 of the metal panel 42, in the manner shown in FIG. 2, the metal panel is moved straight upward into engagement with the support frame 36 (FIG. 1). The cam surfaces 190 (FIG. 3) on the retainer flanges 180 in the support frame engaging section 84 engage the lower flanges 40 on a pair of adjacent parallel support members 38 of the support frame 36. Force is then applied against the cam surfaces 190 on the retainer flanges 180. This force resiliently deflects the main spring sections 78 of the retainer elements 48 inward away from the sections 92 and 96 (FIG. 2) of the outer side wall 90 of the metal panel 42. The upper retainer arms 154 and lower retainer arms 168 slide along the connector walls 106 and 108 (FIG. 2).

When the retainer flanges 180 have cleared the edges of the lower flanges 40 on the support member 38, the natural resilience of the deflected main spring sections 78 snaps the main spring sections from deflected conditions back to the installed condition shown in FIG. 4. As this occurs, the main spring sections 78 of the retainer elements 48 impact against the connector walls 106 and 108. The impact of the main spring sections 78 against the connector walls 106 and 108 results in audible clicks which can be heard by an installer. This informs the installer that the retainer elements 48 have properly engaged the support members 38 in the support frame 36.

As the metal panel 42 is moved upward into engagement with the support frame 36, the force applicator sections 206 of the positioning spring sections 86 press against the lower flanges 40 on the adjacent support members 38. This results in the metal panel 42 being urged downward relative to the support frame 36 so that the retainer surfaces 194 on the retainer flanges 180 are all in firm abutting engagement with upper side surfaces of the lower flanges on the support members 38. Since the distance from the retainer surfaces 194 on the retainer flanges 180 to the lower major side surface 72 of the metal panel 42 is the same, the lower major side surface 72 of the panel 42 is positioned in a parallel relationship with the longitudinal axes of the adjacent support members 38 and is positioned the same distance downward from the support members 38. This results in all of the metal panels 42 in the ceiling system 22 (FIG. 1) having lower side surfaces 72 which are disposed in the same horizontal plane.

When the metal panel 42 has been installed on the support frame 36, the metal panel is securely held against movement relative to the support frame. The retainer elements 48 cooperate with the support frame 36 to hold each of the panels 42 against upward, downward and sideward movement relative to the support frame. Therefore, the panels 42 can not be unintentionally dislodged from the ceiling system 22.

Panel Removal

It is contemplated that from time to time it may be desired to remove a metal panel 42 from the metal ceiling system 22. When this is to be done, it is merely necessary to deflect the main spring section 78 of a retainer element 48 along one of the edge portions 56 or 58 of the metal panel 42. As the main spring section 78 is resiliently deflected, the retainer flange 180 is moved out of engagement with the lower flange 40 on the support member 38.

As this occurs, the resilient positioning spring section 86 of the retainer element 48 will move an associated corner portion, for example, the corner portion 62, slightly downward. When both of the retainer elements 48 along an edge portion, for example the edge portion 56 (FIG. 2) of a metal panel 42, have been disengaged in this manner, the metal panel can be slid sideward. The retainer elements 48 along the opposite edge portion 58 are disengaged from the next adjacent support member 38 by moving the metal panel slightly downward and sideward.

Figure 9:
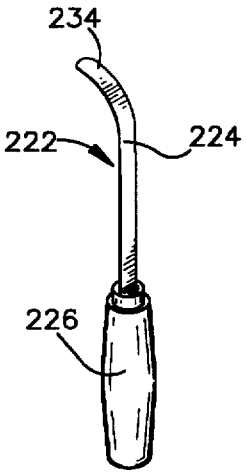
FIG. 9 is a pictorial illustration (on a reduced scale) of a panel removal tool.

It is contemplated that a panel removal tool 222 (FIG. 9) may advantageously be used to sequentially deflect the main spring sections 78 of retainer elements 48 along an edge portion, for example, the edge portion 56, of a metal panel 42. The panel removal tool 222 includes a thin curved resiliently deflectable blade 224 and a handle 226.

Figure 10:
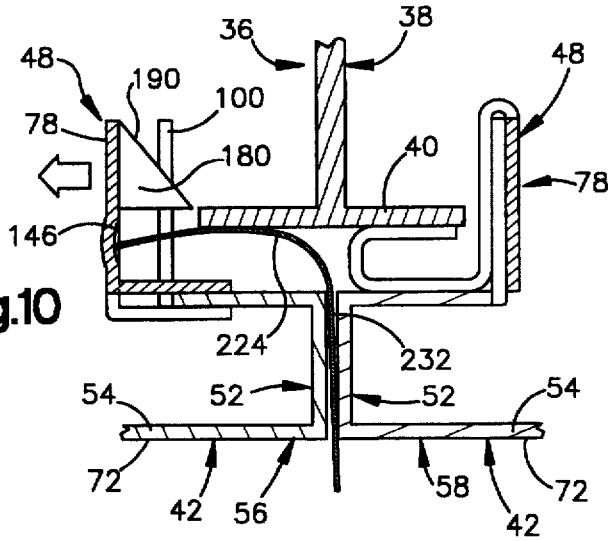
FIG. 10 is a fragmentary sectional view, generally similar to FIG. 7, illustrating the manner in which the panel removal tool of FIG. 9 is utilized to disengage a retainer element from a support frame member during removal of a panel from the ceiling system of FIG. 1.

When a panel 42 is to be disengaged from a support member 38, the resilient blade is inserted into a narrow slot 232 (FIGS. 8 and 10) between adjacent metal panels 42. As the resilient blade 224 is inserted through the slot 232, a leading end 234 of the resilient blade moves into engagement with the lower flange 40 on a support member 38 and is deflected sidewardly, that is, toward the left as viewed in FIG. 10. Continued application of force to the handle 226 results in the leading end portion 234 of the blade 224 being moved into engagement with the recess 146 in the main spring section 78 of a retainer element 48.

Continued application of force to the handle 226 of the panel removal tool 222 results in the resiliently deflected blade 224 (FIG. 10) applying force against a side surface of the recess 146. This force deflects the main spring section 78 of the retainer element 48 toward the left (as viewed in FIG. 10) until the retainer flange 180 moves clear of the lower flange 40 of the support member 38. As the retainer flange 180 moves clear of the lower flange 40 of the support member 38, the resiliently compressed positioning spring section 86 of the retainer element 48 causes the retainer element to move slightly downward.

The force applied to the handle 226 is then reduced and the cam surface 190 on the retainer flange 180 moves into engagement with the lower flange 40 on the support member 38. The natural resilience of the main spring section 78 causes the main spring section to return to the installed condition shown in FIG. 4 and the retainer flange 180 on the retainer element 48 to move beneath the flange 40 on the support member 38.

After one of the retainer elements 48 along an edge portion, for example the edge portion 56 (FIG. 2) of the metal panel 42 has been disengaged from a support member with the tool 222, the blade portion 224 of the tool is withdrawn from the slot 232 between the adjacent panels 42. The panel removal tool 222 is then utilized to disengage the second retainer element 48 along the edge portion, for example the edge portion 56, of the panel 42.

This results in both of the retainer elements 48 along the edge portion 56 of the panel 42 being disengaged from a support member 38. The edge portion 56 of the metal panel is then moved downward clear of the adjacent panel and moved sideward into an underlapping relationship with the adjacent panel. As this occurs, the retainer flanges 48 along the opposite edge portions, that is, the edge portion 58, of the metal panel 42, are disengaged from the next adjacent support member 38. This results in the metal panel 42 being disengaged from the metal ceiling system 22.

Since the removed metal panel 42 and its retainer elements 48 were not damaged during removal from the metal ceiling system 22, the metal panel can be reinstalled in the ceiling system. This enables the metal panels 42 to be selectively removed from the metal ceiling system 22 to provide access to a location above the metal ceiling system. It should be noted that a panel in the center of the metal ceiling system 22 can be removed without removing metal panels adjacent to the edge portions of the ceiling system.

The panel removal tool 222 is necessary to flex the main spring section 78 of a retainer element 48 to release a metal panel 42. Therefore, only a person with a panel removal tool 222 can readily disengage a panel from the metal ceiling system 22 without destroying the metal panel. This provides a degree of security for any items which may be disposed above the metal ceiling system 22, such as wiring and/or fluid conduits.

Conclusion

The present invention relates to a method and apparatus for use in connecting a panel 42 with a support frame 36. The apparatus includes an improved retainer element 48 having a mounting section 76 which is connectable with a rim portion 52 of the panel 42. The retainer element 48 has a main spring section 78 which extends outward from the mounting section 76. A retainer section 80 is disposed at an end 78 the main spring section 78 opposite from the mounting section 76. The retainer section 80 engages both the rim portion 52 of the panel 42 and the support frame 36 to interconnect the panel and the support frame. A positioning spring section 86 is advantageously provided to apply force against the support frame 36 to urge the panel to a desired position relative to the support frame.

The retainer section 80 of the retainer element 48 includes retainer arms 154 and 168 which engage opposite side surfaces 160 and 169 on the rim portion 52 of the panel 42. A retainer flange 180 has a cam surface 190 which is engageable with the support frame 36 to deflect the main spring section 78 as the panel is positioned relative to the support frame. The retainer arms 154 and 168 cooperate with the rim portion 52 of the panel 42 to guide movement of the main spring section 78 relative to the rim portion of the panel.

When a panel 42 is to be disconnected from the support frame 36, a flexible removal tool 222 is inserted between the panels (FIG. 10) and pressed against the main spring section 78 of the retainer element 48. Force transmitted from the removal tool 222 to the main spring section 78 of the retainer element 48 deflects the main spring section. As the main spring section 78 is deflected, the retainer flange 180 is moved out of engagement with the support frame 36.

Having described the invention, the following is claimed:

1. An apparatus for use in connecting a support frame with a sheet metal panel having a main section and a rim portion with parallel inner and outer side walls and a connector wall which extends between the inner and outer side walls and having a first side surface and a second side surface opposite from the first side surface, said apparatus comprising a mounting section connectable with the inner side wall of the rim portion of the sheet metal panel, said mounting section including a base section having surface means for engaging an inner side surface of the inner side wall of the rim portion of the sheet metal panel, a second section having surface means for engaging an outer side surface of the inner side wall of the rim portion of the sheet metal panel, and a connector section which is integrally formed as one piece with said base section and said second section of said mounting section and which is extendable across an edge portion of the inner side wall of the rim portion of the sheet metal panel, an elongated main spring section which is integrally formed as one piece with said base section of said mounting section and has a longitudinal central axis which extends parallel to a longitudinal central axis of the connector wall of the rim portion of the sheet metal panel when said mounting section is connected with the rim portion of the sheet metal panel, said main spring section having a side surface area which extends parallel to the outer side wall of the rim portion of the sheet metal panel when said mounting section is connected with the rim portion of the sheet metal panel, and a retainer section connected with an end portion of said main spring section opposite from said mounting section and integrally formed as one piece with said main spring section, said retainer section including a retainer flange which extends transverse to said main spring section and is integrally formed as one piece with said main spring section, said retainer flange having cam surface means which slopes away from said main spring section, said cam surface means being engageable with the support frame to resiliently deflect said main spring section from an initial position to a deflected position during interconnection of the sheet metal panel and the support frame, said main spring section being moveable from the deflected position back toward the initial position as the sheet metal panel and support frame are interconnected, said retainer flange having retainer surface means for engaging the support frame upon movement of said main spring section from the deflected position back toward the initial position to block movement of the sheet metal panel in a direction away from the support frame, said retainer section including a first retainer arm which extends transverse to said main spring section and is integrally formed as one piece with said main spring section, said first retainer arm having first surface means for engaging a first side surface on the connector wall of the rim portion of the sheet metal panel, said retainer section including a second retainer arm which extends transverse to said main spring section and is integrally formed as one piece with said main spring section, said second retainer arm having second surface means for engaging a second side surface on the connector wall of the rim portion of the sheet metal panel, said first and second surface means on said first and second retainer arms being slidable along the first and second side surfaces on the connector wall of the rim portion of the sheet metal panel during movement of said main spring section between the initial and deflected positions.

2. An apparatus as set forth in claim 1 wherein said retainer flange has a side surface which extends between said cam surface means and said retainer surface means, said first and second retainer arms being spaced from said retainer flange and having central axes which extend parallel to said side surface of said retainer flange.

3. An apparatus as set forth in claim 1 further including a positioning spring section which extends transverse to said main spring section and is integrally formed as one piece with said second section of said mounting section, said positioning spring section having surface means for applying force against the support frame to urge the rim portion of the panel away from the support frame.

4. An apparatus for use in connecting a panel with a support frame, said apparatus comprising a mounting section connectable with a rim portion of the panel, a longitudinally extending main spring section having a first end portion which is connected with said mounting section, said main spring section being resiliently deflectable relative to said mounting section, first and second retainer arms connected with said main spring section and extending transversely to said main spring section, said first retainer arm having first surface means for engaging a first side of the rim portion of the panel, said second retainer arm having second surface means for engaging a second side of the rim portion of the panel, said first and second surface means being slidable along the first and second sides of the rim portion of the panel upon deflection of said main spring section, and retainer means for engaging the support frame to block movement of the panel relative to the support frame, said retainer means being connected with a second end portion of said main spring section opposite from said first end portion of said main spring section.

5. An apparatus as set forth in claim 4 wherein said retainer means is movable relative to the support frame to resiliently deflect said main spring section during interconnection of the support frame and the panel.

6. An apparatus as set forth in claim 4 further including a second spring section connected with said mounting section and extending from said mounting section in a direction transverse to said main spring section, said second spring section adapted to apply force to the support frame to press said retainer means against the support frame.

7. An apparatus for use in connecting a support frame with a panel having a rim portion including parallel inner and outer side walls and a connector wall exending between the inner and outer side walls, said apparatus comprising a mounting section connectable with the rim portion of the panel, a longitudinally extending main spring section extending from said mounting section along a longitudinally extending section of the rim portion of the panel when said mounting section is connected with the rim portion of the panel, said main spring section having a longitudinal central axis which extends parallel to a longitudinal central axis of the longitudinally extending section of the rim portion of the panel when said mounting section is connected with the rim portion of the panel, and a retainer section connected with an end of said longitudinally extending main spring section opposite from said mounting section, said retainer section including a retainer flange which extends transversely to the longitudinal central axis of said main spring section, said retainer flange having cam surface means for engaging the support frame and for transmitting force from the support frame to resiliently deflect said main spring section away from the longitudinal central axis of the longitudinally extending section of the rim portion of the panel from an initial position to a deflected position during interconnection of the panel and the support frame, said main spring section being movable from the deflected position back to the initial position with a snap action upon movement of said main spring section from the deflected position back toward the initial position as the panel and support frame are interconnected, said retainer flange having retainer surface means for engaging the support frame upon movement of said main spring section from the deflected position back toward the initial position to block movement of the panel relative to the support frame, said retainer section further including first and second retainer arms connected with said main spring section adjacent to said retainer flange and extending transversely to the longitudinal central axis of said main spring section, said first retainer arm having first side surface means for engaging a first side surface of the connector wall, said second retainer arm having second side surface means for engaging a second side surface of the connector wall, said first and second retainer arms cooperating to guide movement of said retainer section relative to the connector wall during movement of said main spring section between the initial and deflected positions.

8. An apparatus as set forth in claim 7 wherein said retainer surface means extends parallel to said first side surface means on said first retainer arm and to said second side surface means on said second retainer arm.

9. An apparatus for use in connecting a panel with a support frame, said apparatus comprising a mounting section connectable with a rim portion of the panel, a longitudinally extending main spring section extending from said mounting section along a longitudinally extending section of the rim portion of the panel when said mounting section is connected with the rim portion of the panel, said main spring section having a longitudinal central axis which extends parallel to a longitudinal central axis of the longitudinally extending section of the rim portion of the panel when said mounting section is connected with the rim portion of the panel, a retainer section connected with an end of said longitudinally extending main spring section opposite from said mounting section, said retainer section including a retainer flange which extends transversely to the longitudinal central axis of said main spring section, said retainer flange having cam surface means for engaging the support frame and for transmitting force from the support frame to resiliently deflect said main spring section away from the longitudinal central axis of the longitudinally extending section of the rim portion of the panel from an initial position to a deflected position during interconnection of the panel and the support frame, said main spring section being movable from the deflected position back to the initial position with a snap action upon movement of said main spring section from the deflected position back toward the initial position as the panel and support frame are interconnected, said retainer flange having retainer surface means for engaging the support frame upon movement of said main spring section from the deflected position back toward the initial position to block movement of the panel relative to the support frame, and a positioning spring section which extends transversely to and is connected with said main spring section, said positioning spring section having surface means for applying force against the support frame to urge the rim portion of the panel away from the support frame in a first direction, said retainer surface means on said retainer flange being engageable with the support frame to block movement of the rim portion of the panel away from the support frame in the first direction.

10. An apparatus as set forth in claim 9 wherein said retainer section further includes first and second retainer arms connected with said main spring section, said first and second retainer arms cooperating to guide movement of said retainer section relative to the rim portion of the panel during movement of said main spring section between the initial and deflected positions.

11. An apparatus for use in connecting a support frame with a panel having a rim portion including a side wall which extends transversely to a major side surface on a main section of the panel, said apparatus comprising a mounting section connectable with the rim portion of the panel, a longitudinally extending main spring section extending from said mounting section along a longitudinally extending section of the rim portion of the panel when said mounting section is connected with the rim portion of the panel, said main spring section having a longitudinal central axis which extends parallel to a longitudinal central axis of the longitudinally extending section of the rim portion of the panel when said mounting section is connected with the rim portion of the panel, and a retainer section connected with an end of said longitudinally extending main spring section opposite from said mounting section, said retainer section including a retainer flange which extends transversely to the longitudinal central axis of said main spring section, said retainer flange having cam surface means for engaging the support frame and for transmitting force from the support frame to resiliently deflect said main spring section away from the longitudinal central axis of the longitudinally extending section of the rim portion of the panel from an initial position to a deflected position during interconnection of the panel and the support frame, said main spring section being movable from the deflected position back to the initial position with a snap action upon movement of said main spring section from the deflected position back toward the initial position as the panel and support frame are interconnected, said retainer flange having retainer surface means for engaging the support frame upon movement of said main spring section from the deflected position back toward the initial position to block movement of the panel relative to the support frame, said mounting section including a base section and a second section which is connected with said base section, said base section of said mounting section having first side surface means which is engageable with a first side surface on said side wall, said second section of said mounting section having second side surface means which is engageable with a second side surface on said side wall.

12. An apparatus as set forth in claim 11 further including a positioning spring section which extends outward from said second section of said mounting section and has a surface means for applying force against the support frame to urge the rim portion of panel away from the support frame toward a position in which the major side surface on the main section of the panel is in predetermined location relative to the support frame.

13. An apparatus for use in connecting a support frame with a panel having a rim portion including paralled inner and outer side walls and a connector wall extending between the inner and outer side walls, said apparatus comprising a mounting section connectable with a the rim portion of the panel, a longitudinally extending main spring section extending from said mounting section along a longitudinally extending section of the rim portion of the panel when said mounting section is connected with the rim portion of the panel, said main spring section having a longitudinal central axis which extends parallel to a longitudinal central axis of the longitudinally extending section of the rim portion of the panel when said mounting section is connected with the rim portion of the panel, and a retainer section connected with an end of said longitudinally extending main spring section opposite from said mounting section, said retainer section including a retainer flange which extends transversely to the longitudinal central axis of said main spring section, said retainer flange having cam surface means for engaging the support frame and for transmitting force from the support frame to resiliently deflect said main spring section away from the longitudinal central axis of the longitudinally extending section of the rim portion of the panel from an initial position to a deflected position during interconnection of the panel and the support frame, said main spring section being movable from the deflected position back to the initial position with a snap action upon movement of said main spring section from the deflected position back toward the initial position as the panel and support frame are interconnected, said retainer flange having retainer surface means for engaging the support frame upon movement of said main spring section from the deflected position back toward the initial position to block movement of the panel relative to the support frame, said mounting section being engageable with said inner side wall, said retainer flange adopted to extend away from said main spring section through an opening in the inner side wall to a position in which said retainer surface means on said retainer flange faces toward the connector wall when said mounting section is connected with the rim portion of the panel.

14. An apparatus as set forth in claim 13 wherein said retainer section further includes first and second retainer arms connected with said main spring section, said first retainer arm having first side surface means for engaging a first side surface of the connector wall, said second retainer arm having second side surface means for engaging a second side surface of the connector wall, said first and second retainer arms cooperating to guide movement of said retainer section relative to the connector wall during movement of said main spring section between the initial and deflected positions.

15. An apparatus for use in connecting a panel with a support frame, said apparatus comprising a mounting section connectable with a rim portion of the panel, a longitudinally extending main spring section extending from said mounting section along a longitudinally extending section of the rim portion of the panel when said mounting section is connected with the rim portion of the panel, said main spring section having a longitudinal central axis which extends parallel to a longitudinal central axis of the longitudinally extending section of the rim portion of the panel when said mounting section is connected with the rim portion of the panel, and a retainer section connected with an end of said longitudinally extending main spring section opposite from said mounting section, said retainer section including a retainer flange which extends transversely to the longitudinal central axis of said main spring section, said retainer flange having cam surface means for engaging the support frame and for transmitting force from the support frame to resiliently deflect said main spring section away from the longitudinal central axis of the longitudinally extending section of the rim portion of the panel from an initial position to a deflected position during interconnection of the panel and the support frame, said main spring section being movable from the deflected position back to the initial position with a snap action upon movement of said main spring section from the deflected position back toward the initial position as the panel and support frame are interconnected, said retainer flange having retainer surface means for engaging the support frame upon movement of said main spring section from the deflected position back toward the initial position to block movement of the panel relative to the support frame, said main spring section being movable away from the initial position toward the deflected position under the influence of force applied against said main spring section by a tool to disengage said retainer surface means from the support frame when said mounting section is connected with the rim portion of the panel.

16. An apparatus as set forth in claim 15 wherein said main spring section includes surface means for defining a longitudinally extending recess in said main spring section, said surface means which defines said recess in said main spring section being engagable by the tool to transmit force to said main spring section.

17. A method of connecting a panel with a support frame, said method comprising the steps of connecting a plurality of retainer elements with a rim portion of the panel, each of the retainer elements having a longitudinally extending and resiliently deflectable main spring section having a first end portion connected with a mounting section of the retainer element and a second end portion connected with a retainer flange, said step of connecting the retainer elements with the rim portion of the panel includes connecting the mounting section of each of the retainer elements with the rim portion of the panel, and engaging the support frame with each of the retainer elements to retain the panel against movement relative to the support frame, said step of engaging the support frame with each of the retainer elements includes engaging the support frame with a cam surface on the retainer flange of each of the support elements, resiliently deflecting the main spring section of each of the retainer elements from an initial position toward a deflected position under the influence of force applied against the retainer flange of each of the retainer elements by the support frame, thereafter, disengaging the cam surface on the retainer flange of each of the support elements from the support frame, moving the main spring section of each of the retainer elements from the deflected position toward the initial position under the influence of the resilience of the main spring section to move a retainer surface on the retainer flange of each of the retainer elements relative to the support frame, and impacting each of the retainer elements against the panel to generate audible signals upon movement of the main spring section of each of the retainer elements from the deflected position toward the initial position.

18. A method as set forth in claim 17 wherein each of the retainer elements has first and second retainer arms which are connected with the main spring section of each of the retainer elements and engage opposite side surfaces on the rim portion of the panel, said step of resiliently deflecting the main spring section of each of the retainer elements includes sliding the first and second retainer arms of each of the retainer elements along opposite side surfaces on the rim portion of the panel while maintaining the first and second retainer arms of each of the retainer elements in engagement with opposite side surfaces on the rim portion of the panel.

19. A method of connecting a panel with a support frame, said method comprising the steps of connecting a plurality of retainer elements with a rim portion of the panel, each of the retainer elements having a longitudinally extending main spring section and first and second retainer arms, said step of connecting the retainer elements with the rim portion of the panel includes connecting a first end portion of the main spring section of each of the retainer elements with the rim portion of the panel with the first and second retainer arms of each of the retainer elements in engagement with opposite side surfaces on the rim portion of the panel, and engaging the support frame with each of the retainer elements to retain the panel against movement relative to the support frame, said step of engaging the support frame with each of the retainer elements includes resiliently deflecting the main spring section of each of the retainer elements and sliding the first and second retainer arms of each of the retainer elements along opposite side surfaces on the rim portion of the panel while deflecting the main spring section of each of the retainer elements.

20. A method as set forth in claim 19 wherein said step of deflecting the main spring section of each of the retainer elements includes engaging the support frame with a cam surface connected with a second end portion of the main spring section of each of the retainer elements and resiliently deflecting the main spring sections of the retainer elements under the influence of forces applied against the cam surfaces by the support frame.

21. A method as set forth in claim 19 further including the step of disengaging the retainer elements from the support frame after performing said step of engaging a support frame with each of the retainer elements, said step of disengaging the retainer elements from the support frame includes engaging the support frame with an end portion of a flexible member, said step of engaging the support frame with an end portion of the flexible member includes deflecting the end portion of the flexible member, thereafter, pressing the end portion of the flexible member against the main spring section of one of the retainer elements, and deflecting the main spring section of the one retainer element under the influence of force applied against the main spring section of the one retainer element by the flexible member.

22. A method as set forth in claim 19 wherein said step of engaging the support frame with each of the retainer elements includes impacting each of the retainer elements against the panel to generate audible signals.

23. A method of connecting a panel with a support frame and subsequently disconnecting the panel from the support frame, said method comprising the steps of connecting a plurality of retainer elements with a rim portion of the panel, each of the retainer elements having a longitudinally extending and resiliently deflectable main spring section having a first end portion connected with a mounting section of the retainer element and a second end portion connected with a retainer flange of the retainer element, said step of connecting the retainer elements with the rim portion of the panel includes connecting the mounting section of each of the retainer elements with the rim portion of the panel, and engaging the support frame with each of the retainer flanges to retain the panel against movement relative to the support frame, said step of engaging the support frame with each of the retainer flanges includes resiliently deflecting the main spring section of one retainer element of the plurality of retainer elements relative to the mounting section of the one retainer element to move the main spring section of the one retainer element from an initial position toward a deflected position under the influence of force applied against the retainer flange of the one retainer element by the support frame, thereafter, moving the main spring section of the one retainer element from the deflected position toward the initial position under the influence of the resilience of the main spring section to move a retainer surface on the retainer flange of the one retainer element relative to the support frame, and thereafter, disengaging the one retainer element from the support frame, said step of disengaging the one retainer element from the support frame includes pressing a tool against the main spring section of the one retainer element, and resiliently deflecting the main spring section of the one retainer element under the influence of force applied against the main spring section of the one retainer element by the tool to move the retainer surface on the retainer flange of the one retainer element relative to the support frame.

24. A method as set forth in claim 23 wherein said step of disengaging the one retainer element from the support frame includes inserting a flexible portion of the tool between edge portions of adjacent panels, engaging the support frame with the flexible portion of the tool, deflecting the flexible portion of the tool under the influence of force transmitted between the flexible portion of the tool and the support frame, thereafter, pressing the flexible portion of the tool against the main spring section of the one retainer element, and deflecting the main spring section of the one retainer element under the influence of force applied against the main spring section of the one retainer element by the flexible portion of the tool.

25. A method as set forth in claim 23 wherein the one retainer element has first and second retainer arms which are connected with the main spring section of the one retainer element and engage opposite side surfaces on the rim portion of the panel, said step of resiliently deflecting the main spring section of the one retainer element includes sliding the first and second retainer arms along opposite side surfaces on the rim portion of the panel while maintaining the first and second retainer arms in engagement with opposite side surfaces on the rim portion of the panel.

26. A method as set forth in claim 23 wherein each of the retainer elements has a positioning spring section which is connected with the main spring section of each of the retainer elements, said step of engaging the support frame with each of the retainer elements to retain the panel against movement relative to the support frame includes urging the rim portion of the panel away from the support frame by applying force against the support frame with each of positioning spring sections of each of the retainer elements and blocking movement of the rim portion of the support panel away from the support frame under the influence of the positioning spring sections by engagement of the retainer flanges on each of the retainer elements with the support frame, said step of resiliently deflecting the main spring section of the one retainer element under the influence of force applied against the main spring section of the one retainer element by the tool being at least partially performed while the positioning spring sections of each of the retainer elements continue to apply force against the support frame urging the rim portion of the panel away from the support frame.

27. A method of connecting a plurality of panels with a support frame and subsequently disconnecting at least one of the panels from the support frame, said method comprising the steps of engaging the support frame with a plurality of retainer elements on each of the panels, said step of engaging the support frame with a plurality of retainer elements on each of the panels includes resiliently deflecting the retainer elements from initial positions to deflected positions, moving the retainer elements from the deflected positions toward the initial positions under the influence of the resilience of the retainer elements, and positioning the panels with an edge portion of a first panel adjacent to an edge portion of a second panel and with major side surfaces of the first and second panels in a coplanar relationship, and, thereafter, disengaging at least one of the retainer elements on the first panel from the support frame, said step of disengaging at least one of the retainer elements on the first panel from the support frame includes inserting a portion of a tool between the adjacent edge portions of the first and second panels while maintaining the major side surfaces of the first and second panels in a coplanar relationship, and resiliently deflecting the one of the retainer elements on the first panel by applying force against the one of the retainer elements on the first panel with the tool while at least a portion of the tool is disposed between adjacent edge portions of the first and second panels.

28. A method as set forth in claim 27 wherein said step of disengaging at least one of the retainer elements on the first panel from the support frame is performed while maintaining the second panel stationary relative to the support frame.

29. A method as set forth in claim 27 wherein said step of disengaging at least one of the retainer elements on the first panel from the support frame includes engaging the support frame with an end of the portion of the tool inserted between adjacent edge portions of the first and second panels, deflecting the portion of the tool inserted between the adjacent edge portions of the first and second panels under the influence of force transmitted between the support frame and the tool, and, thereafter, pressing the end of the portion of the tool inserted between adjacent edge portions of the first and second panels against the one of the retainer elements on the first panel to perform said steps of applying force against the one of the retainer elements on the first panel and resiliently deflecting the one of the retainer elements on the first panel.

30. A method of connecting a plurality of panels with a support frame and subsequently disconnecting at least one of the panels from the support frame, said method comprising the steps of engaging the support frame with a plurality of retainer elements on each of the panels, said step of engaging the support frame with a plurality of retainer elements on each of the panels includes resiliently deflecting the retainer elements from initial positions to deflected positions, moving the retainer elements from the deflected positions toward the initial positions under the influence of the resilience of the retainer elements, and positioning the panels with an edge portion of a first panel adjacent to an edge portion of a second panel, and, thereafter, disengaging at least one of the retainer elements on the first panel from the support frame, said step of disengaging at least one of the retainer elements on the first panel from the support frame includes inserting a portion of a tool between the adjacent edge portions of the first and second panels while maintaining the second panel stationary relative to the support frame, and resiliently deflecting the one of the retainer elements on the first panel by applying force against the one of the retainer elements on the first panel with the tool while at least a portion of the tool is disposed between adjacent edge portions of the first and second panels.

31. A method as set forth in claim 30 wherein said step of disengaging at least one of the retainer elements on the first panel from the support frame includes engaging the support frame with an end of the portion of the tool inserted between adjacent edge portions of the first and second panels, deflecting the portion of the tool inserted between the adjacent edge portions of the first and second panels under the influence of force transmitted between the support frame and the tool, and, thereafter, pressing the end of the portion of the tool inserted between adjacent edge portions of the first and second panels against the one of the retainer elements on the first panel to perform said steps of applying force against the one of the retainer elements on the first panel and resiliently deflecting the one of the retainer elements on the first panel.

* * * * *